US008919417B2

(12) United States Patent
Wen et al.

(10) Patent No.: US 8,919,417 B2
(45) Date of Patent: Dec. 30, 2014

(54) HEAD RAIL OF WINDOW COVERING AND LID FASTENER

(75) Inventors: Yu-Che Wen, Guishan Township (TW); Chih-Yao Chang, Taichung (TW)

(73) Assignee: Nien Made Enterprise Co., Ltd., Taichung (TW)

( * ) Notice: Subject to any disclaimer, the term of this patent is extended or adjusted under 35 U.S.C. 154(b) by 0 days.

(21) Appl. No.: 13/453,892

(22) Filed: Apr. 23, 2012

(65) Prior Publication Data

US 2013/0015154 A1 Jan. 17, 2013

(30) Foreign Application Priority Data

Jul. 15, 2011 (CN) ..... 2011 2 0249985 U

(51) Int. Cl.
*E06B 9/36* (2006.01)
*E06B 9/323* (2006.01)

(52) U.S. Cl.
CPC . *E06B 9/323* (2013.01); *E06B 9/36* (2013.01); *Y10S 160/902* (2013.01)
USPC ..... 160/173 V; 160/902

(58) Field of Classification Search
USPC ..... 160/173 V, 177 V, 178.1 V, 902, 34, 160/178.1 R
See application file for complete search history.

(56) References Cited

U.S. PATENT DOCUMENTS

| | | | | | |
|---|---|---|---|---|---|
| 2,602,978 | A | * | 7/1952 | Clark | 248/251 |
| 2,792,999 | A | * | 5/1957 | Lorentzen | 248/264 |
| 4,425,956 | A | * | 1/1984 | Terlecke | 160/168.1 R |
| 4,750,539 | A | * | 6/1988 | Chang | 160/176.1 V |
| 4,802,644 | A | * | 2/1989 | Oskam | 248/251 |
| 4,828,002 | A | * | 5/1989 | Ashby | 160/38 |
| 4,935,988 | A | * | 6/1990 | Ford et al. | 16/87.4 R |
| 5,445,205 | A | * | 8/1995 | Hansen | 160/168.1 R |
| 5,584,459 | A | * | 12/1996 | Meyer | 248/251 |
| 6,039,295 | A | * | 3/2000 | de Beijer | 248/262 |
| 6,994,143 | B2 | * | 2/2006 | McCarty et al. | 160/168.1 R |

* cited by examiner

*Primary Examiner* — David Purol

(74) *Attorney, Agent, or Firm* — Tracy M. Heims; Apex Juris, pllc

(57) ABSTRACT

A head rail of a window covering includes a rail member, two rail lids engaging opposite ends of the rail member, and two lid fasteners to fix a rail lids. The lid fastener includes a main plate, two clip plates, and two stop plates. The lid fastener engages the rail member with the clip plates clipping the rail member and the stop plates holding the rail lid to securely fix the rail lid to the rail member. The lid fastener provides a fast and easy way to engage and disengage the rail lid.

5 Claims, 7 Drawing Sheets

HEAD RAIL OF WINDOW COVERING AND LID FASTENER

BACKGROUND OF THE INVENTION

1. Field of the Invention

The present invention relates generally to a window covering, and more particularly to a head rail of a window covering and a lid fastener for fixing a rail lid to the head rail.

2. Description of the Related Art

Typically, a conventional window covering includes at least a head rail and a shading member disposed under the head rail. The shading member may be slats or a shade. The conventional window covering further is provided with a controlling unit, including a cord and a transmission member to raise or lower the window covering. The head rail is an elongated hollow member to receive the controlling unit, and two rail lids are mounted on opposite ends of the head rail to hide the controlling unit in the head rail.

FIG. 1 shows a rail lid 2 engaging a head rail 1 to close the ends 1*a* thereof. A plate 3 is attached to a bottom of the rail lid 2 and the head rail 1 through two bolts 4. The bolts 4 are inserted into two bores 3*a* on the plate 3, and screwed into threaded holes 2*a* on the rail lid 2. However, there are some drawbacks, including:

1. The rail lid is fixed by bolts that the assembly worker has to use a screwdriver to fasten or loose the bolts. Without the screwdriver, the assembly job can not be done.
2. The blots are small that the assembly worker is hard to put the bolts into the bores of the plate, and sometime, he/she may lose them. This is an annoying problem when the assembly worker is working on assembling the window covering and can't find the bolts.
3. There is an extra work to drill the threaded holes on the rail lid and make the plate.

SUMMARY OF THE INVENTION

The primary objective of the present invention is to provide a head rail of a window covering equipped with a lid fastener to engage and disengage the rail lid in a fast and easy way.

According to the objective of the present invention, a lid fastener for fixing a rail lid to an end of a rail member of a window covering includes a main plate; and two clip plates connected to opposite ends of the main plate, wherein an angle between either one of the clip plates and the main plate is an acute angle.

In an embodiment, the main plate has a curved portion.

In an embodiment, the lid fastener further has at least a stop plate connected to the main plate.

In an embodiment, the lid fastener further has an extending plate connected to a free end of the clip plate.

In an embodiment, the extending plate has a bore.

In an embodiment, both the clip plates are curved.

The present invention further provides a head rail of a window covering, including a rail member having an open end and at least a protrusion on at least a corner thereof; a rail lid engaging the open end of the rail member; and a lid fastener engaging the rail member, wherein the lid fastener has at least a clipping portion to engage the protrusion of the rail member.

In an embodiment, the protrusion is provided on a bottom of the rail member, and the lid fastener has a main plate and two clip plates on opposite ends of the plate that the clipping portion is formed between the main plate and the clip plate.

In an embodiment, between the main plate and the clip plate is an acute angle.

In an embodiment, the lid fastener has a curved portion on the main plate.

In an embodiment, the rail lid has a pin inserted into the open end of the rail member and a board on an end of the pin, and the area of the board is bigger than the open end that the clip plates of the lid fastener touch the board.

In an embodiment, the lid fastener further has an extending plate connected to a free end of the clip plate.

In an embodiment, the extending plate has a bore.

In an embodiment, the lid fastener has at least a stop plate to hold the rail lid.

In an embodiment, the rail lid has at least a lock slot on a bottom thereof, and the lid fastener has at least a stop plate inserted into the lock slot to hold the rail lid.

DETAILED DESCRIPTION OF THE INVENTION

Figure 1:
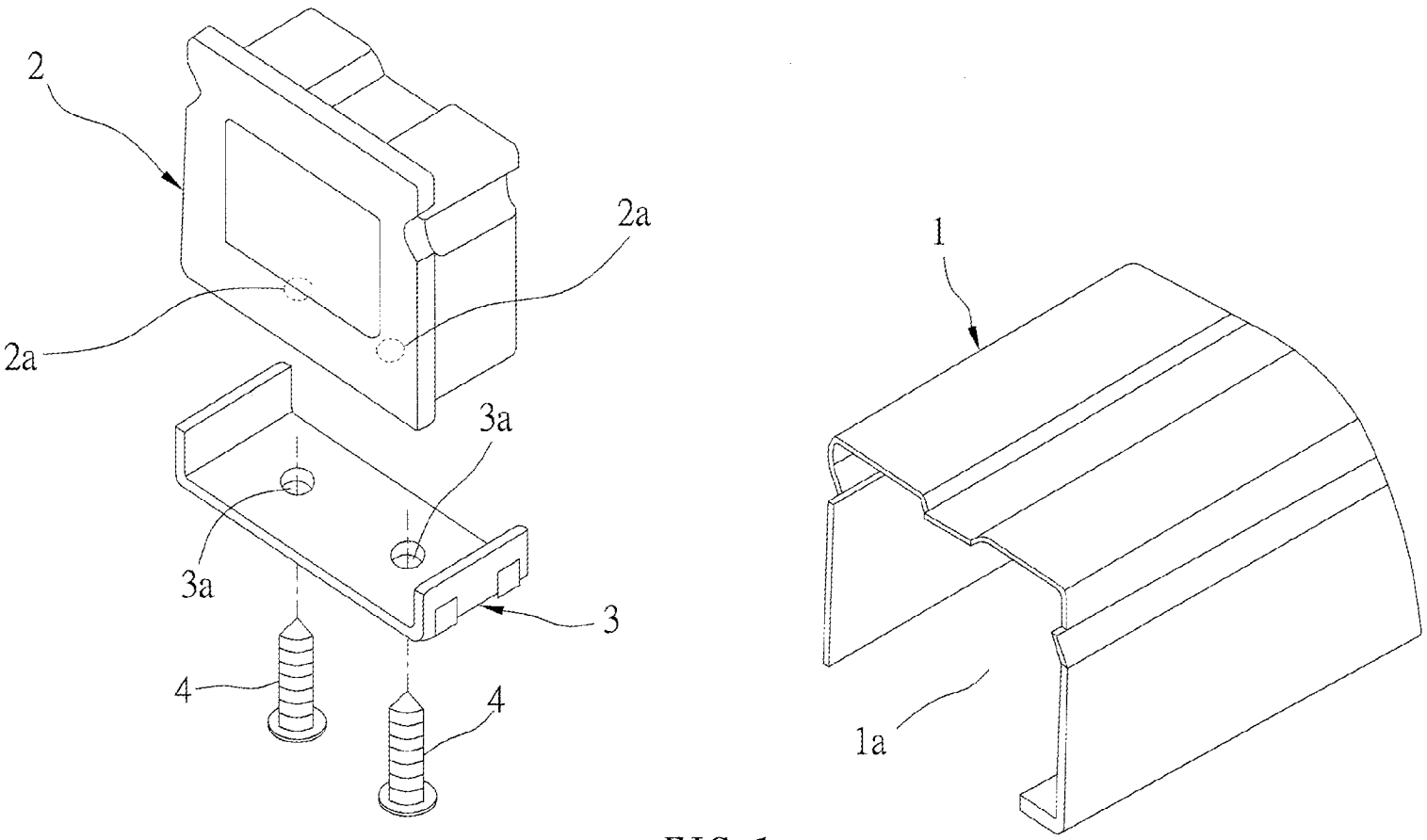
FIG. 1 (PRIOR ART)
FIG. 1 is an exploded view of the conventional head rail and its lid fastener.
Figure 2:
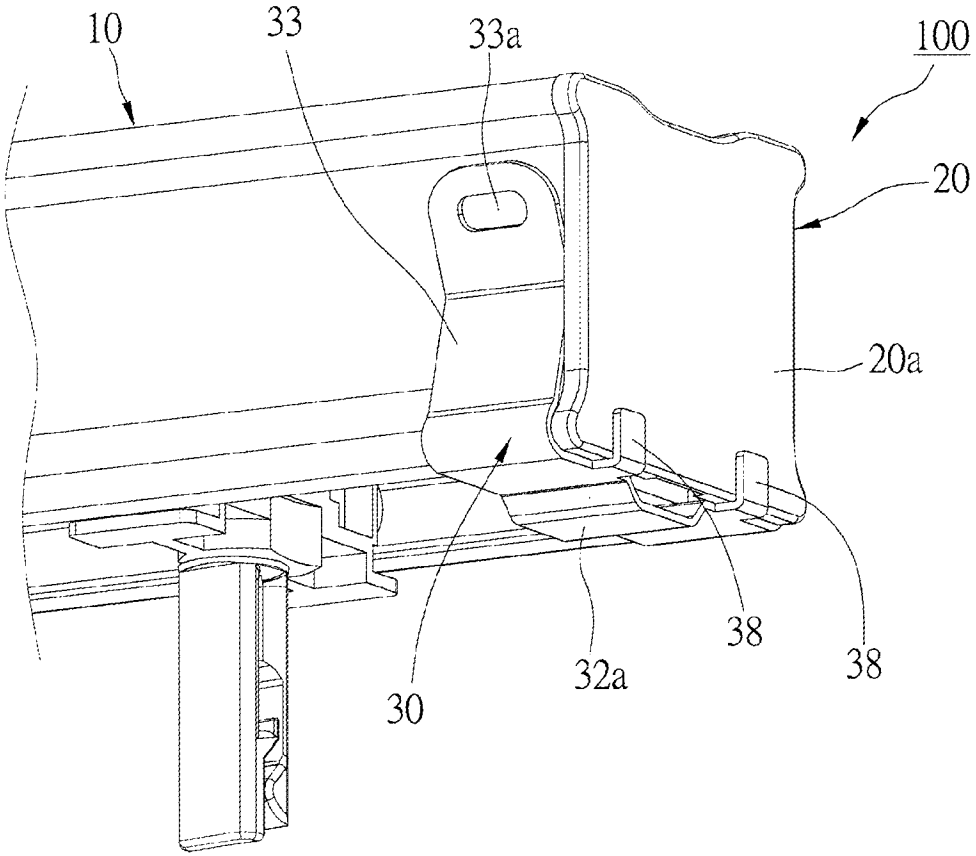
FIG. 2 is a perspective view of a preferred embodiment of the present invention.
Figure 3:
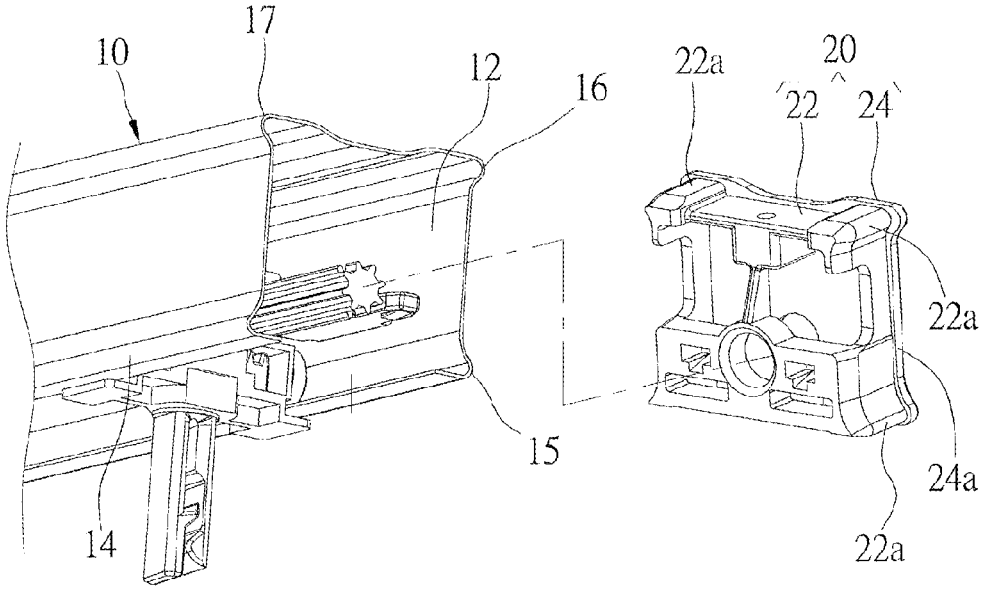
FIG. 3 is an exploded view of the preferred embodiment of the present invention.
Figure 3:
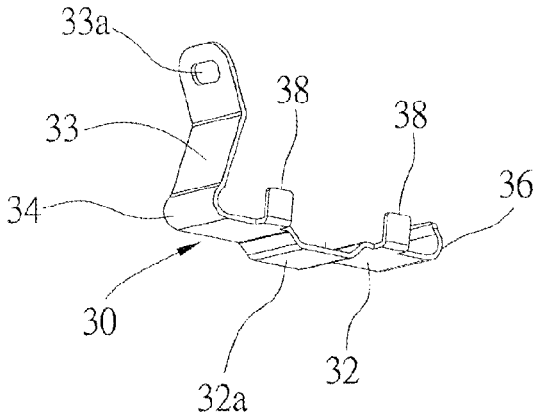

As shown in FIG. 2 and FIG. 3, a head rail 100 of a window covering of the preferred embodiment of the present invention includes a rail member 10, two rail lids 20, and two lid fasteners 30 (only one rail lid and one lid fastener are shown in drawings).

The rail member 10 is elongated and hollow with two open ends 12. A controlling unit (not shown) is received in the rail member 10 to control the window covering. The rail member 10 has a rectangular profile with four arched protrusions 14, 15, 16, and 17 on four corners thereof and four recesses on interior sides of the protrusions.

The rail lid 20 includes a pin 22 and a board 24 on an end of the pin 22. The pin 22 is inserted into the open end 12 of the rail member 10, and the board 24 is attached to the open end 12. The rail lid 20 has four protrusions 22*a* at four corners of the pin 22 to engage the recesses when the pin 22 enters the rail member 10. The board 24 is bigger in area than the open end 12 of the rail member 10 that an inner side 24*a* of the board 24 may be attached to the open end 12.

Figure 4:
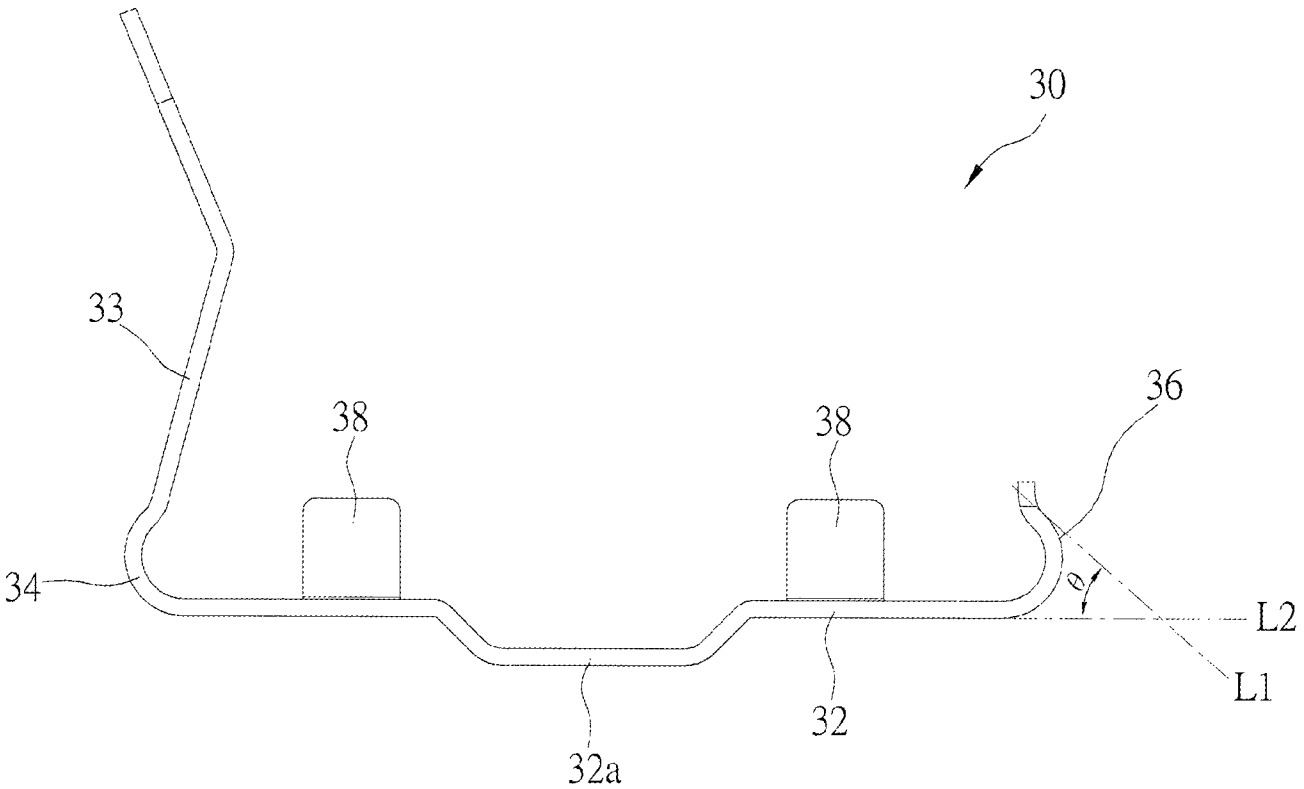
FIG. 4 is a lateral view of the lid fastener of the preferred embodiment of the present invention.

As shown in FIG. 4, the lid fastener 30 is formed from a bent metallic or plastic plate. The lid fastener 30 has an elongated main plate 32 with a first clip plate 34 and a second clip plate 36 on opposite ends thereof. In the embodiment, the first clip plate 34 and the second clip plate 36 are two curved pieces fitting the protrusions of the rail member 10. A clipping portion is formed between the first or the second clip plates 34, 36 and the main plate 32 to engage the protrusions of the rail member 10. In order to firmly hold the rail member 10, the clip plates 34, 36 are curved and have specified angles. It is preferable that an angle θ between a line L1 passing a free end of the clip plate 34 or 36 and an extending line of the main plate 32 is an acute angle, referring to FIG. 2 and FIG. 3, therefore the first and the second clip plates 34, 36 may clip the protrusions 14, 15 on a bottom of the rail member 10 to make the lid fastener 30 firmly engage the rail member 10. At the same time, the first and the second clip plates 34, 36 may touch the inner side 24*a* of the board 24 of the rail lid 20.

In the present embodiment, the lid fastener 30 further has two stop plates 38 connected to the main plate 32. There is a predetermined angle between the stop plate 38 and the main plate 32, and the preferable angle is a right angle at ninety degrees. The stop plates 38 press an outer surface of the board 24 of the rail lid 20 to securely hold the rail lid 20.

In order to engage and disengage the lid fastener 30 with the rail member 10 in an easier way the lid fastener 30 is provided with an extending plate 33 connected to a free end of the first clip plate 34 that user may bend the extending plate 33 outwards to disengage the lid fastener 30 with the rail member 10. The extending plate 33 has a bore 33*a* adjacent to a free end thereof that user may insert a tool, such as screwdriver, into the bore 33*a* to bend the extending plate 33 in order to easily disengage the lid fastener 30 with the rail member 10. The lid fastener 30 has a curved portion 32*a* at middle of the main plate 32. User may press the curved portion 32*a* to bend the first and the second clip plates 34, 36 outwards that user may easily disengage the lid fastener 30. It is obviously that no tool, such as screwdriver, or bolt is needed to assemble or disassemble the rail lid 20 according to the present invention.

Figure 5:
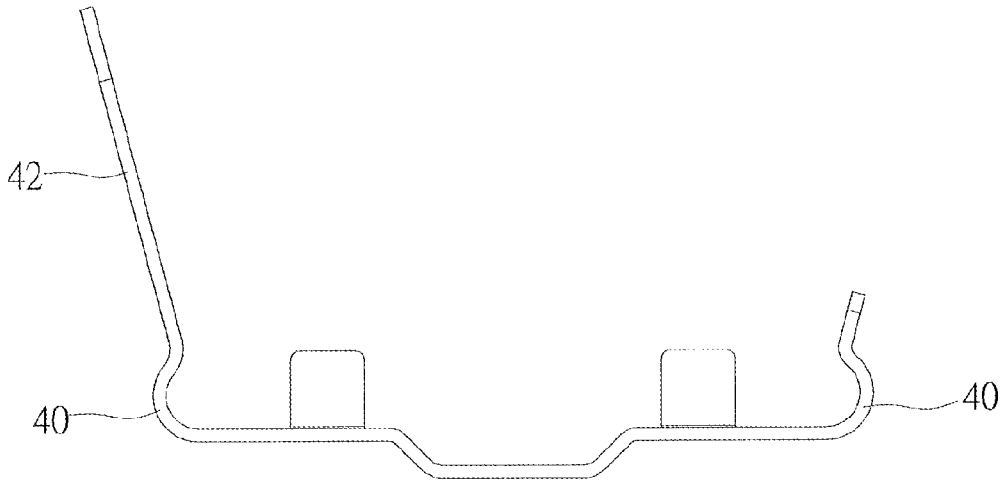
FIG. 5 is a lateral view of alternate lid fastener of the preferred embodiment of the present invention.
Figure 6:
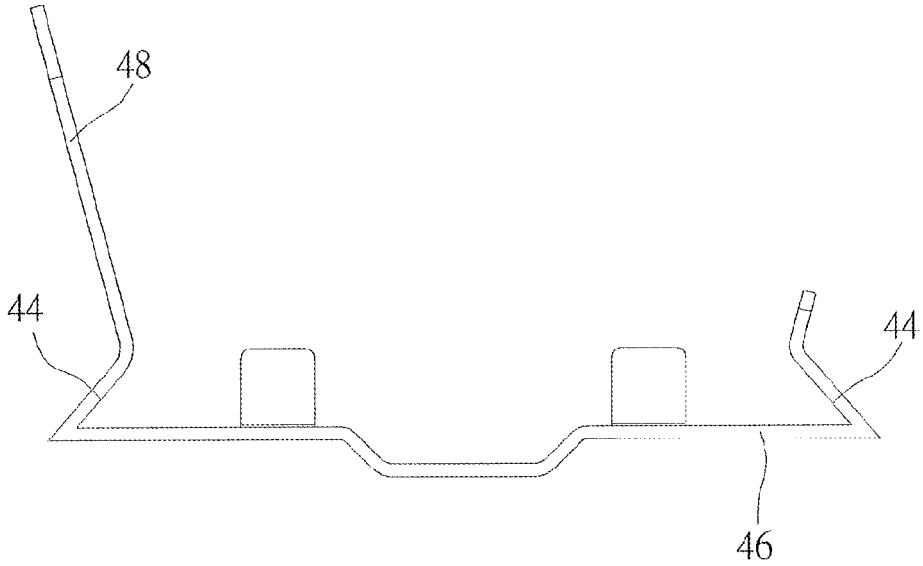
FIG. 6 is a lateral view of another alternate lid fastener of the preferred embodiment of the present invention.

FIG. 5 and FIG. 6 show two alternate lid fasteners. As shown in FIG. 5, each clip plate 40 is curved and an extending plate 42 is flat. As shown in FIG. 6, each clip plate 44 is flat with an acute angle between the clip plate 44 and a main plate 46, and an extending plate 48 is flat. The above lid fasteners only provide one extending plate, and it is obvious that it can provide two extending plates respectively on the first and the second clip plates.

Figure 7:
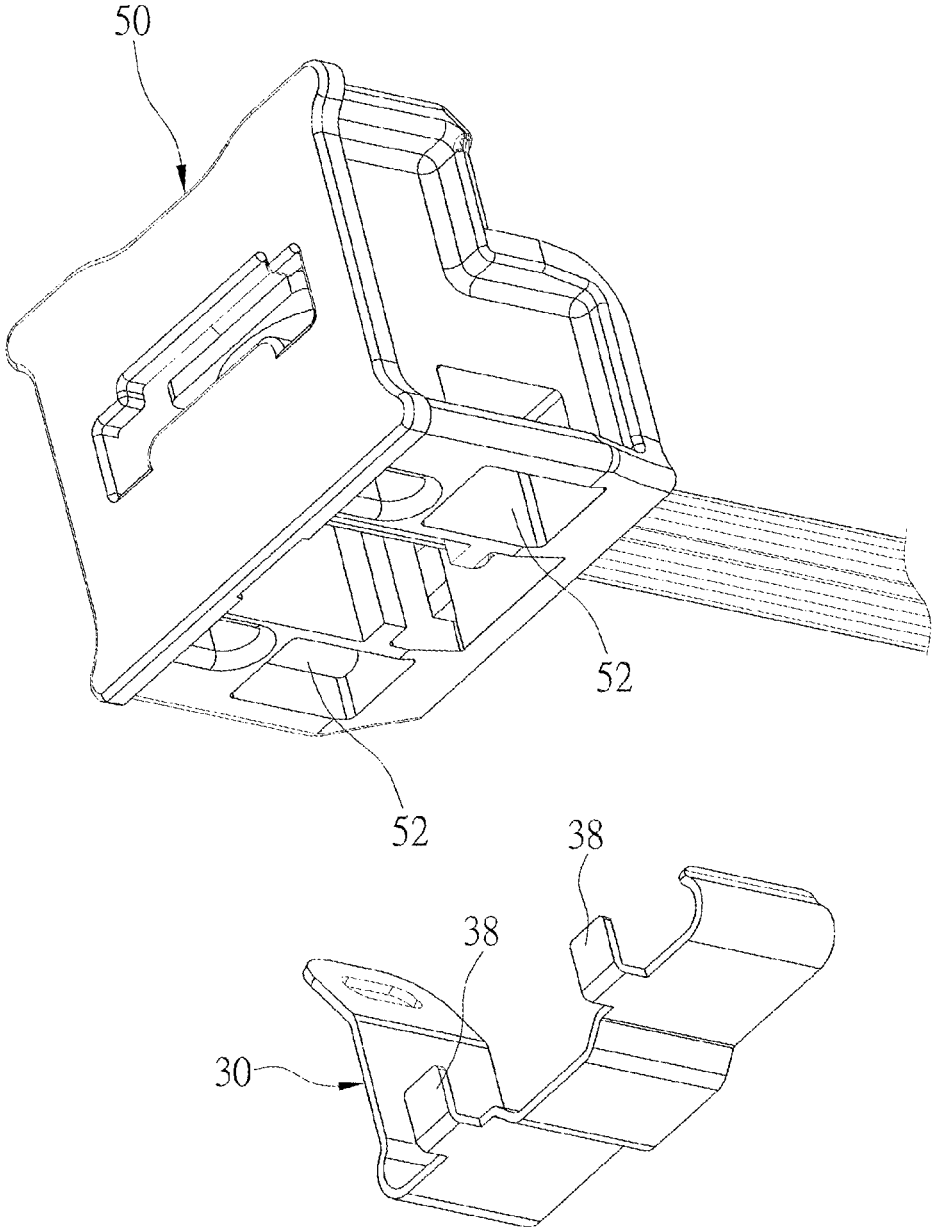
FIG. 7 is an exploded view of the preferred embodiment of the present invention, showing the lid fastener and the rail lid with lock slots.
Figure 8:
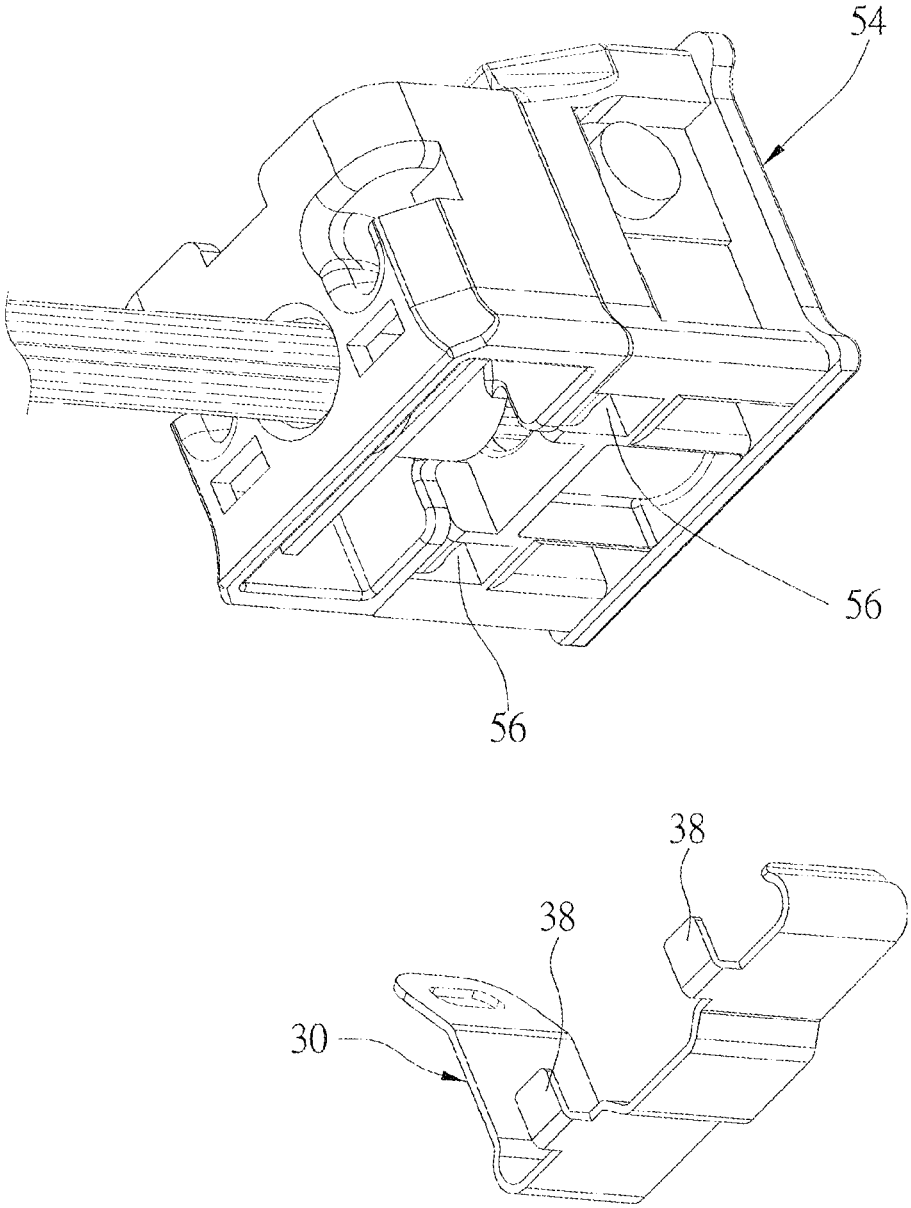
FIG. 8 is an exploded view of the preferred embodiment of the present invention, showing the lid fastener and another rail lid with lock slots.

FIG. 7 and FIG. 8 show two different rail lids. In FIG. 7, the rail lid 50 has two lock slots 52 on a bottom thereof. In FIG. 8, the rail lid 54 has ribs on a bottom thereof to form two lock slots 56 therebetween. The lid fastener 30, which is the same as above, inserts the stop plates 38 into the lock slots 52 or 56 to press the sidewalls thereof when the lid fastener 30 engages the rail member 10.

The description above is only a few preferred embodiments of the present invention and the equivalence of the present invention is still in the scope of claim construction of the present invention.

What is claimed is:

1. A head rail of a window covering, comprising:

a rail member having an open end and at least two protrusions on the lower bottom corners thereof;

a rail lid engaging the open end of the rail member; and a lid fastener engaging the rail member so as to secure the rail lid to the open end of the rail member, wherein the lid fastener comprises:

a main plate;

two clip plates connected to opposite ends of the main plate, the clip plates being secured to the at least two protrusions on the lower bottom of the rail member wherein an acute angle is between each of the clip plates and the main plate and engages the rail lid; at least one stop plate between the clip plates on the main plate where the stop plate is provided on an edge of the main plate, wherein opposite ends of the edge are connected to the ends connected to the clip plates respectively;

a curved portion formed at a middle of said main plate so that when said curved portion is pressed said clip plates bend outward and where said clip plates and said stop plate are projected from said main plate in the same direction;

said curved portion of said main plate is projected in a direction opposite to said clip plates and said stop plate; and an extending plate that is connected to a free end of said clip plate wherein said clip plate is bent inwards, and said extending plate is bent outwards.

2. The lid fastener as defined in claim 1, wherein the extending plate has a bore.

3. The lid fastener as defined in claim 1, wherein both the clip plates are curved.

4. The head rail as defined in claim 1 wherein the rail lid has a pin that is matingly configured to said open end of the rail member so that it can be inserted into the open end of the rail member and a board on an end of the pin where said perimeter of said board is similar in shape but greater in area than said pin so that when said pin is inserted into said open end of said rail member said board is matingly configured with and pressed against said end of said rail member.

5. The head rail as defined in claim 1, wherein the rail lid has at least a lock slot on a bottom thereof, and the lid fastener has at least a stop plate inserted into the lock slot to hold the rail lid.

* * * * *